US007762017B2

(12) United States Patent
Huang

(10) Patent No.: US 7,762,017 B2
(45) Date of Patent: Jul. 27, 2010

(54) CUSTOMIZABLE ENVELOPE ASSEMBLY

(75) Inventor: Margaret Huang, Irvine, CA (US)

(73) Assignee: M. & Co., Inc., Irvine, CA (US)

( * ) Notice: Subject to any disclaimer, the term of this patent is extended or adjusted under 35 U.S.C. 154(b) by 971 days.

(21) Appl. No.: 11/541,407

(22) Filed: Sep. 29, 2006

(65) Prior Publication Data

US 2008/0078816 A1 Apr. 3, 2008

(51) Int. Cl.
*G09F 1/00* (2006.01)

(52) U.S. Cl. ..... 40/789; 40/124.06; 40/124.09; 40/124.16; 229/92.8; 229/103.3; 229/306

(58) Field of Classification Search ..... 40/124.04, 40/124.09, 124.191, 124.18, 124.16, 770, 40/774; 206/495, 485, 476, 232; 229/71, 229/75, 82, 84
See application file for complete search history.

(56) References Cited

U.S. PATENT DOCUMENTS

| | | | |
|---|---|---|---|
| 185,630 | A | 12/1876 | Davis |
| 596,387 | A | 12/1897 | Smith |
| 827,809 | A | 8/1906 | Mitchell |
| 892,461 | A | 7/1908 | Stevens |
| 1,164,805 | A | 12/1915 | Gibbs |
| 1,461,635 | A | 7/1923 | Szczerba |
| 2,792,167 | A | 5/1957 | Sparks |
| 4,244,511 | A | 1/1981 | Coleman |
| 6,694,657 | B2 | 2/2004 | Tsao |
| 2003/0208936 | A1 | 11/2003 | Lee |

*Primary Examiner*—Lesley Morris
*Assistant Examiner*—Shin Kim
(74) *Attorney, Agent, or Firm*—Fulwider Patton LLP

(57) ABSTRACT

A customizable envelope formed from interchangeable components allows the user to create various color and texture arrangements. The envelope is formed using two separate pieces of paper or other similar sheet material, each of which includes two foldable end flaps and a central portion. Both sheets are generally rectangular in shape and, when assembled to form the finished envelope, are preferably oriented so that their elongate axes are at a 90° angle to each other. In one form, the central portion of one sheet has a pair of elongated slits preferably formed parallel to the longitudinal axis of the sheet and located near the top and bottom edges, respectively. The second sheet is sized so that it will be received in these slits. After assembly, the portion of the first, slitted sheet, exterior to the slits appears to frame the central portion of the second sheet, providing a framed opening on either the inner or outer surface of the completed envelope. Once the envelope is assembled, an invitation, postcard, photograph or other form of insert can be placed inside, and the envelope closed around the insert by folding the end flaps inwardly toward each other. Various arrangements of closure tabs can be provided on the end flaps to hold the end flaps together when the envelope is closed. Various shapes of end flaps also can be utilized. By folding the end flaps backwardly after the envelope is opened, the flaps can be used to form a stand for erecting and displaying any material disposed within the framed opening.

22 Claims, 7 Drawing Sheets

CUSTOMIZABLE ENVELOPE ASSEMBLY

FIELD OF THE INVENTION

This invention relates generally to envelopes, and more particularly, to a customizable envelope which can be configured by the user in various ways and for different applications.

BACKGROUND OF THE INVENTION

Envelopes of unitary construction for mailing letters, invitations, and the like using part of the envelope surface for the name and address of the recipient are well known. However, these envelopes generally have a number of disadvantages.

First, the envelopes generally tend to have a very plain appearance, suitable mainly for everyday or routine business use. In most cases, the envelope is monochromatic and has a very plain and ordinary surface on the outside of the envelope for placing the name and address of the intended recipient. The flap used to close the envelope also is very plain and ordinary, normally with straight edges and a generally rectangular or triangular shape.

While high quality, custom-made envelopes with engraved designs, colored papers or other decorative features are available, they tend to be very expensive. Moreover, once a custom envelope is made, the design generally cannot be changed, without placing another order for a different design with the attendant additional expense and extra volume of envelopes to store.

Most envelopes, whether of the mass produced or custom-made variety, are normally pre-assembled by the manufacturer and sold to users in an "as-is" condition. They are not intended to be rearranged or altered by the user in order to vary the appearance of the envelope or its intended function. Moreover, such envelopes are generally designed to have just one function, namely, to loosely hold a letter or other item inside the envelope until it is received, and thereafter to be discarded by the recipient after the envelope is opened and the contents removed.

Such conventional envelopes are not ideally suited for mailing photographs. When a photograph is simply included in a conventional envelope along with a letter, for example, it may become separated from the envelope and misplaced once the envelope is opened by the recipient. In addition, the recipient who desires to display the photograph after its receipt, generally needs to supply a separate frame in order to do so. This can be unnecessarily expensive, especially when the recipient intends to display a large number of photos for only a relatively short period of time, such as is often the case with holiday photographs received as part of a holiday greeting. Specialty photo mailers are known, but they tend to be unattractive and awkward to use without a photograph inside. A recipient who receives a specialty photo mailer with no photograph inside is likely to believe that the photograph has been lost or accidentally omitted from the envelope. To avoid these embarrassing situations, the sender will generally keep two different kinds of envelopes on hand, conventional envelopes for mailing letters and photo mailers for mailing photos. Once again, this requires additional expense and storage capacity.

A need exists for a customizable envelope which provides a simple and effective means for storing or transporting a letter, invitation, postcard or photograph, and which enables the user to assemble the envelope in a variety of different ways in order to vary the appearance of the envelope or its intended function. Ideally, such an envelope would be relatively inexpensive to manufacture, but would be capable of possessing a very formal or decorative appearance on the outside of the envelope. It also would be multi-functional and would be particularly well-suited for use with photographs both as an envelope designed for protecting a photograph during passage through the mail, and also as a convenient and attractive picture frame and stand for displaying the photograph once the recipient has opened the envelope.

The present invention fulfills these and other needs.

SUMMARY OF THE INVENTION

Briefly, and in general terms, the present invention provides a new and improved envelope assembly which enables the user to configure the envelope in a variety of different ways using a collection of interchangeable parts in order to customize the appearance of the envelope or adapt it to different applications and uses. The parts of the envelope can be relatively inexpensive to manufacture and mass produce, and easy to assemble, but when assembled, may be capable of producing an envelope of attractive or unique design with the appearance of a picture frame on the outside of the envelope in the address area or on the inside of the envelope for framing a photograph or picture. The envelope is useful as a conventional envelope for letters, invitations or the like, or as a mailer for photographs. In the latter application, it may be capable of being reconfigured to act as a picture frame and stand to display the photograph once the envelope has been opened.

The envelope assembly includes a first sheet and a second sheet engaged in a crosswise manner. Each sheet has a central portion and two foldable end flaps on opposite sides of the central portion. The central portion of the first sheet is configured to expose at least a part of the central portion of the second sheet to view through a framed opening defined by a portion of the first sheet, while allowing the end flaps of the second sheet to extend beyond the central portion of the first sheet in a direction traverse to the end flaps of the first sheet when the end flaps are unfolded.

In one embodiment, a pair of slits are formed in the central portion of the first sheet for receiving and engaging the central portion of the second sheet. The slits are configured to limit displacement of the second sheet toward the end flaps of the first sheet, and the end flaps of the second sheet are joined to the central portion of the second sheet at a distance apart slightly greater than the space between the slits to limit displacement of the second sheet relative to the first sheet when the end flaps of the second sheet are folded inwardly toward the central portion of the first sheet.

Each of the slits may be disposed along an opposite edge of the first sheet at a distance spaced inwardly from the edge and may terminate short of the end flap connections to the first sheet, to form a continuous narrow band of material in the central portion of the first sheet that frames the exposed part of the second sheet. In one embodiment, each slit terminates short of the end flap connections by a distance substantially equal to the distance between the slits and the adjacent edges, whereby a band of generally uniform width frames said exposed part of the second sheet.

The first sheet and the second sheet can be formed of a variety of different materials. In one embodiment, the first sheet and the second sheet are formed of different colors or have different surface textures. In yet another embodiment, the second sheet is formed of photo paper.

Optionally, the end flaps of at least one sheet are long enough to overlap each other when folded inwardly over the central portion. In this embodiment, the end flaps of the other sheet may be shorter and only partially cover the central portion when folded inwardly. In an alternative embodiment, the end flaps of at least one sheet may have edges that meet near the central portion when the end flaps are folded inwardly.

The end flaps can have a variety of different shapes, including shapes selected from the group consisting of rectangular, rounded, petal-shaped and fin-shaped. The edges of the end flaps also can have a variety of shapes, selected from the group consisting of straight, curved and scalloped.

In some embodiments, the end flaps on at least one sheet are provided with complimentary locking tabs adapted to interlock with each other to hold the end flaps in a closed position when the end flaps are folded inwardly. In one form, each of the locking tabs has a lateral formation with a restricted neck that defines a notch adapted to receive the neck of the corresponding locking tab in an interlocking relation to fasten the end flaps together. In an alternative form, the end flaps on both sheets are provided with locking tabs projecting outwardly from the free edges of each end flap, the locking tabs on one sheet being axially aligned and providing a first set of locking tabs adapted to overlap with each other when the corresponding end flaps are folded inwardly, the locking tabs on the other sheet being axially aligned with each other and providing a second set of locking tabs adapted to be tucked under the first set of locking tabs when the corresponding end flaps are folded inwardly to fasten the end flaps together in an interlocking relation.

As previously noted, the exposed part of the second sheet may be selectively provided on the inside or the outside of the envelope. When the exposed part of the second sheet is provided on the inside of the envelope, it is ideally suited for displaying a photograph within the framed opening, the end flaps being foldable over the photograph to cover and protect the photograph when the envelope is closed.

Optionally, upon backward folding of the end flaps behind the framed opening, the framed opening will be supported and erected by at least one of the end flaps. In one embodiment, the end flaps at the sides of the framed opening are folded backwardly behind the framed opening, each of said backwardly folded end flaps having a lower portion bent inwardly at a generally right angle to the end flap to form a base for supporting the end flaps and for erecting said framed opening tilted backward at an angle.

The envelope assembly may optionally be sold as a kit of interchangeable parts, the kit including a plurality of sheets, each sheeting have a central portion and two foldable end flaps on opposite sides of the central portion, at least some of the sheets having openings formed therein configured to provide a pair of spaced-apart slits in the central portion thereof adapted to receive and engage the central portion of other sheets in the kit for holding the sheets together in an inter-engaged manner to form an envelope assembly. In one embodiment, the other sheets with the kit are free of said openings and include sheets of different color than the sheets having said openings formed therein.

Other features and advantages of the invention will become apparent from the following detailed description, taken in conjunction with the accompanying drawings, which illustrate, by way of example, features of the invention.

DETAILED DESCRIPTION OF THE PREFERRED EMBODIMENTS

Figure 1:
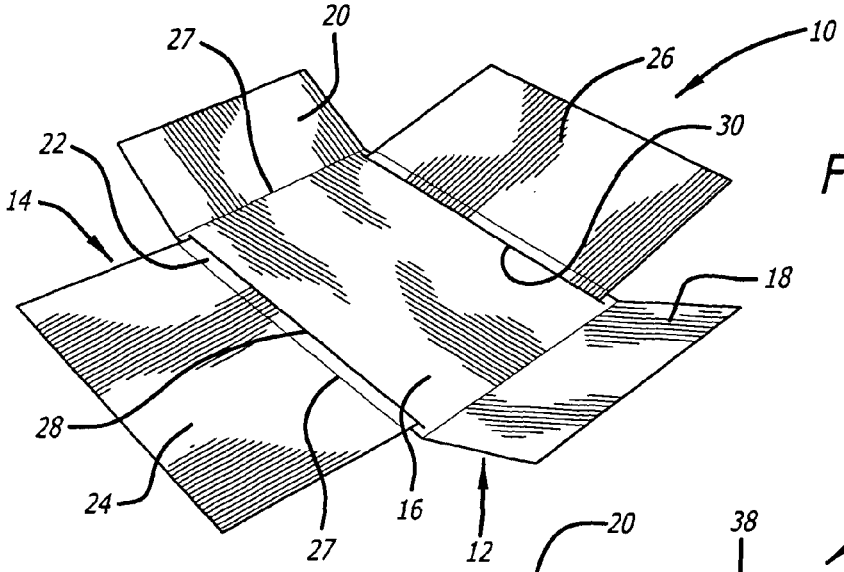
FIG. 1 is a perspective view of the inside of an envelope assembly embodying features of the present invention, showing the envelope in an open position.

As shown in the drawings, which are provided for purposes of exemplary illustration, the invention is embodied in a new and improved envelope assembly 10, which is customizable and useable for a variety of applications.

Referring to FIG. 1, the envelope assembly 10 includes two separate sheets of paper or similar sheet material 12 and 14 arranged in a crosswise fashion. The first sheet 12 has a central portion 16 and two foldable end flaps 18 and 20 disposed on opposite sides of the central portion. The second sheet 14 also has a central portion 22 and two foldable end flaps 24 and 26 disposed on opposite ends of the central portion. The end flaps are adapted to be folded inwardly upon fold lines 27. In the illustrated embodiment, each sheet 12 and 14 has a generally rectangular shape and the two sheets that form the finished envelope 10 are orientated so that their elongate axes are at about 90° to each other. It will be appreciated, however, that other shapes and angular orientations may be used, if desired.

Figure 2:
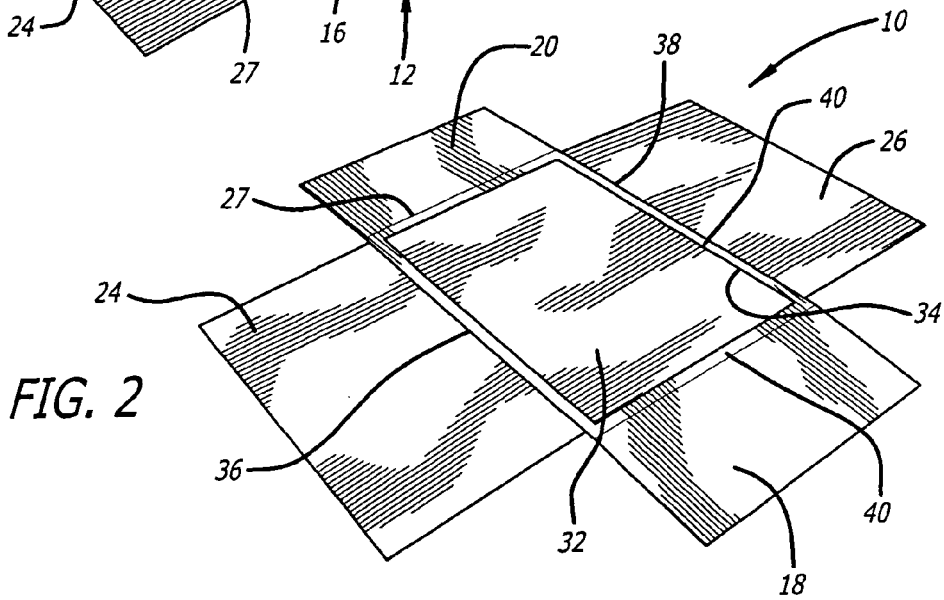
FIG. 2 is a perspective view of the outside of the envelope assembly shown in FIG. 1.

The two sheets 12 and 14 can be engaged with each other in a variety of different ways using different means for joining the sheets together. In one embodiment, the central portion 16 of the first sheet 12 is provided with two elongate slits 28 and 30 respectively formed on opposite sides of the central portion, close to the longitudinal edges thereof 36 and 38, and extending along the edges between the end flaps 18 and 20. The slits 28 and 30 are sized for receiving and engaging the central portion 22 of the second sheet 14, so that the two sheets may be loosely held together in a manner that allows a part 32 of the second sheet 14 in the central portion 22 to be exposed to view through a framed opening 34 formed by the central portion 16 of the first sheet 12, as best shown in FIG. 2. The end flaps 24 and 26 of the second sheet 14 extend beyond the central portion 16 of the first sheet 12 in a direction transverse to the end flaps 18 and 20 of the first sheet, so that the envelope may be closed by folding the end flaps 18, 20, 24 and 26 of both sheets inwardly over the superimposed central portions 16 and 22, as partially shown in FIG. 3.

In accordance with one embodiment, the first and second sheets 12 and 14 are selected by the user from among a collection of interchangeable sheets of different color, texture, flap style, and the like, giving the user the option of customizing the appearance of the envelope by mixing and matching different sheets in various combinations. By choosing sheets of contrasting color, for example, the appearance of the framed opening 34 may be enhanced.

For ease of assembly, the slits 28 and 30 may be provided with a length slightly greater than the width of the sheet portion 22 they are to accommodate. In this way, the sheets 12 and 14 may be easily engaged or disengaged for assembly or disassembly while limiting any side-to-side displacement of the sheet 14 within the slits 28 and 30 between the flaps 18 and 20. By spacing the fold lines 27 for the end flaps 24 and 26 of the second sheet 14 a distance apart only slightly greater than the distance between the slits 28 and 30, longitudinal displacement of the second sheet 14 relative to the slits 28 and 30 also may be limited when the end flaps 24 and 26 are folded inwardly toward the central portion 16 of the first sheet 12. Once assembled, the sheets 12 and 14 can be affixed to each other in a temporary or permanent manner by the use of adhesive or other suitable bonding material placed between the overlapping surfaces of the first and second sheets. Alternatively, however, the two sheets 12 and 14 may be left loosely engaged to permit repeated disassembly or re-assembly of the envelope 10 with different interchangeable sheets, providing the user with a wide range of customization options.

In an alternative embodiment (not shown), a large opening or cut-out is formed in the central portion of the first sheet in lieu of the slits. The opening is configured to leave a narrow band of first sheet material around the perimeter of the central portion of the first sheet to define described above, is then arranged in crosswise fashion with the first sheet, the framed opening. The second sheet, which is essentially the same as the second sheet so that the central portions of the two sheets overlap. The narrow band of first sheet material is then affixed to the central portion of the second sheet by adhesive or other suitable bonding material, to provide a permanent envelope assembly.

The framed opening 34 can be selectively provided on either the inside or outside of the envelope 10 and can have any suitable shape. In one embodiment, the opening 34 is rectangular. However, other shapes can be provided, if designed.

To provide the framed opening 34 with a "picture frame" look, the two slits 28 and 30 may be disposed close to and parallel to the longitudinal edges 36 and 38 of the first sheet 12, but spaced inwardly therefrom by a short distance. In addition, the slits 28 and 30 can be configured to terminate short of the fold lines 27 for the end flaps 18 and 20 of the first sheet 12. The result is a continuous narrow band 40 of first sheet material disposed outside the slits 28 and 30 and along the edges 36 and 38 and the fold lines 27 as shown in FIG. 2, that imparts the appearance of a picture frame around the perimeter portion of the second sheet 14 exposed to view through the framed opening 34.

In one embodiment, the narrow band 40 is provided with a substantially uniform width around the entire perimeter of the framed opening 34. This arrangement can be achieved by terminating each slit 28 and 30 short of the fold lines 27 by a distance substantially equal to the spacing between the slits and the adjacent longitudinal edges 36 and 38 of the first sheet 12. The framed appearance can be further enhanced by making the distance between the fold lines 27 for the end flaps 24 and 26 of the second sheet 14 approximately the same as the distance between the longitudinal edges 36 and 38 of the first sheet 12, so that the central portion 22 of the second sheet does not protrude outwardly beyond the longitudinal edges of the first sheet when the envelope is closed, as best shown in FIG. 5.

Figure 5:
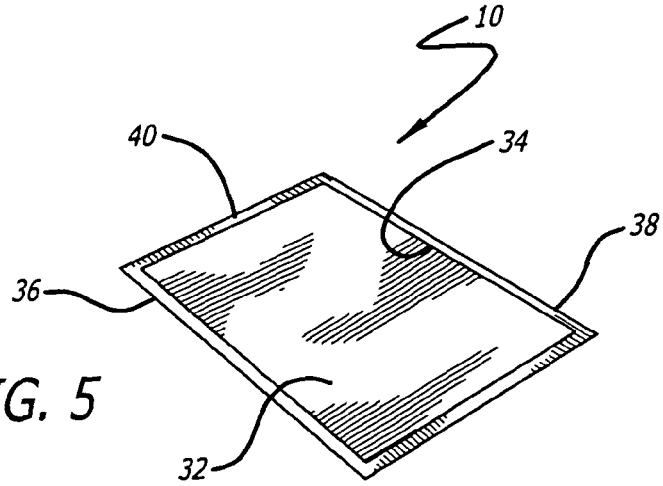
FIG. 5 is a perspective view of the envelope assembly shown in FIG. 4, as viewed from the front side of the envelope and illustrating a framed opening formed on the outside of the envelope.

While the framed opening 34 shown in FIGS. 2 and 5 has a generally rectangular shape, it will be appreciated that the shape of the opening 34 can be changed in various ways, such as by varying the shape of the slits 28 and 30 or the shape of the central portion 22 of the second sheet 14. For example, if the slits 28 and 30 are provided with an arcuate shape, then the top and bottom of the framed opening will be curved. By additionally providing curved sides on the central portion 22 of the second sheet 14, an oval or round frame shape may be obtained.

The framed opening 34 can be provided on the inside or the outside of the envelope 10 as selected by the user, depending on how the two sheets 12 and 14 are assembled.

For example, with the flaps of both sheets open, the second sheet 14 may be put into place by inserting an end flap 26 of the second sheet 14 into one of the slits 28 in the first sheet 12, then sliding it along the underside of the first sheet, and out through the other slit 30 in the first sheet until the flap 26 fully clears the second slit 30 and the two central portions 16 and 22 are superimposed. By passing the second sheet 14 under the central portion 16 of the first sheet 12 in this way, the exposed part 32 of the second sheet 14 will be visible through the framed opening 34 on the underside, or outside, of the envelope, as best shown in FIGS. 2 and 5.

Figure 10:
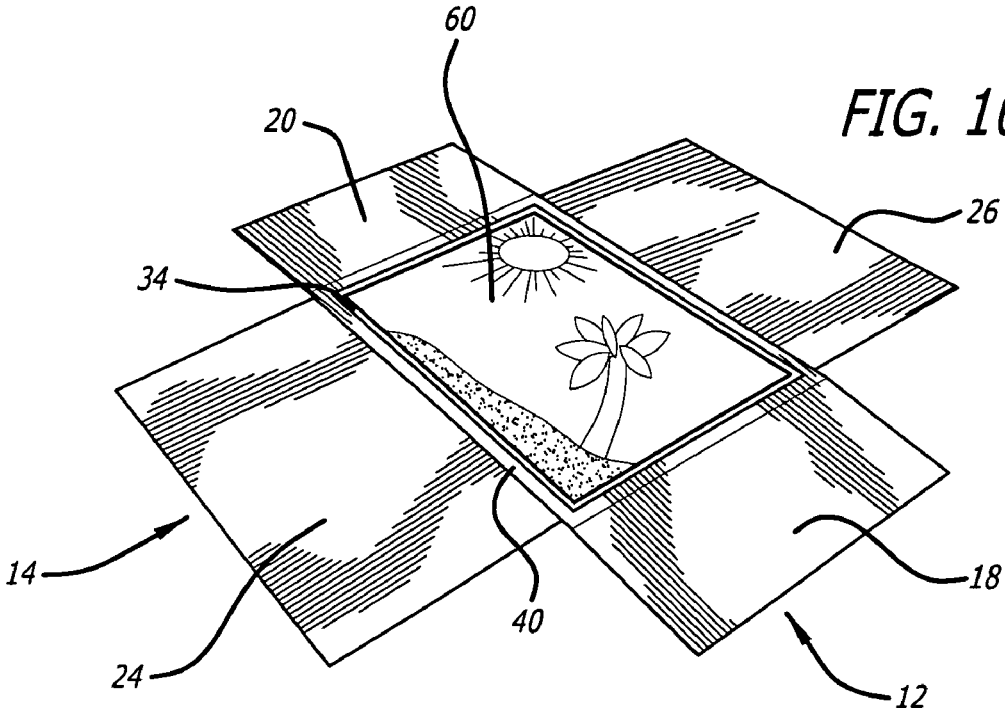
FIG. 10 is a perspective view of an alternative arrangement for the envelope assembly shown in FIG. 2, showing the framed opening on the inside of the envelope with a photograph disposed therein.
Figure 11:
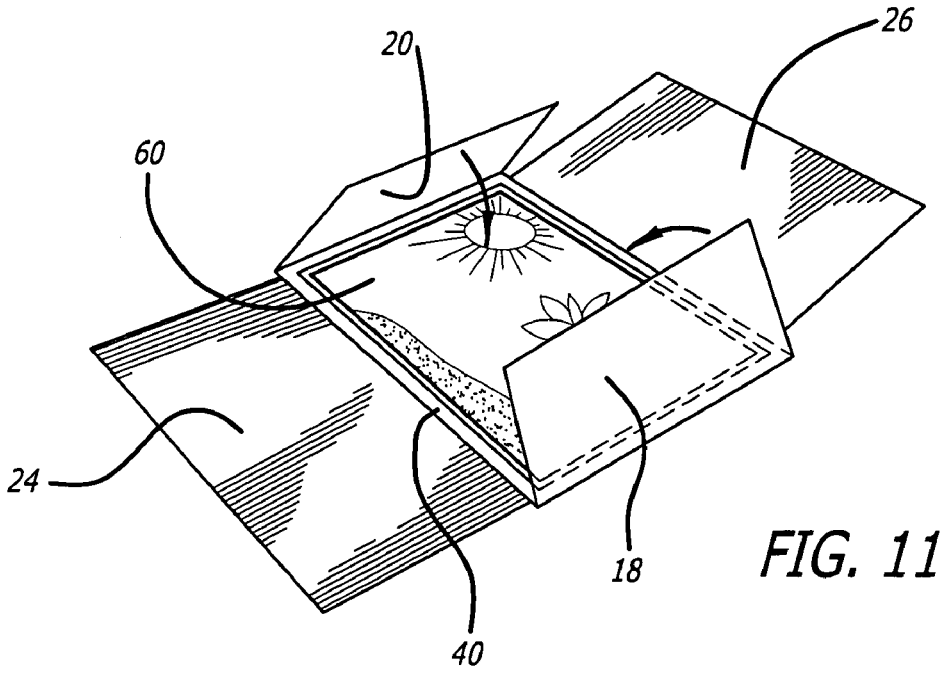
FIG. 11 is a perspective view of the envelope assembly shown in FIG. 10, with the side flaps partially closed.

Alternatively, with the flaps of both sheets open, the second sheet 14 may be put into place by inserting the end flap 26 of the second sheet 14 through the first slit 28 in the opposite direction, then sliding it over the topside of the first sheet 14 and into the second slit 30 in the first sheet 12 until the flap 26 clears the second slit and the central portions 16 and 22 are superimposed. By passing the second sheet 14 over the central portion 16 of the first sheet 12 in this way, the exposed part 32 of the second sheet 14 will be visible through the framed opening 34 on the inside of the envelope, as shown in FIGS. 10 and 11.

Where the two sheets 12 and 14 are made of sufficiently flexible material, the assembly can be accomplished in an alternative manner by simply inserting the end flaps 24 and 26 of the second sheet 14 sequentially through opposite slits 28 and 30 and then pulling the flaps in opposite directions until the central portion 22 of the second sheet lies flat against the central portion 16 of the first sheet 12.

Regardless of which assembly method is used, the two interlocking sheets 12 and 14 may be left loosely engaged with each other by the action of the slits alone or, alternatively, they can be secured to each other by the additional use of adhesive or other suitable bonding material. For example, an adhesive strip (not shown) can be applied between the continuous marrow band 40 and the underlying central portion 22 of the second sheet 14 to secure the position of the two interlocking sheets 12 and 14, and to seal the narrow band 40 in place, thereby reducing the chance of dislodgement or tearing while being mailed.

Once the envelope is assembled, the framed opening 34 can be transformed from the inside to the outside of the envelope, or visa versa, by disassembling and then re-assembling the envelope using one of the alternative methods (assuming the two sheets have not been sealed together) or, more simply, by folding the end flaps 12, 20, 24 and 26 backwards.

Figure 3:
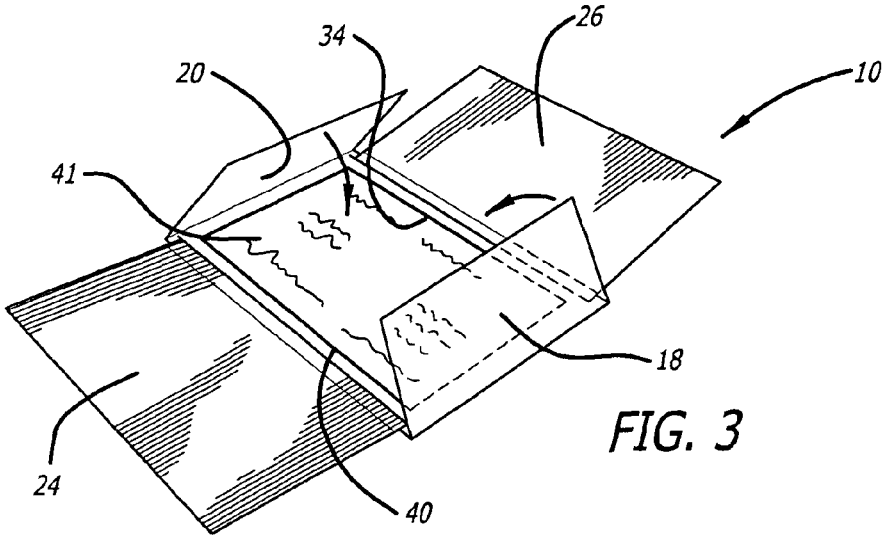
FIG. 3 is a perspective view of the envelope assembly shown in FIG. 1, with the side flaps partially closed, and showing an invitation or other written message card placed inside the envelope.

When the framed opening 34 is placed on the outside of the envelope 10, it provides a convenient and attractive area for carrying writing or other printed information, such as the name and/or name and address of the intended recipient of the envelope. An insert 41 in the form of a letter, postcard, engraved invitation or similar article may then be placed inside the envelope 10 in the space between the end flaps 18, 20, 24 and 26, as shown in FIG. 3. After the insert 41 is placed inside the envelope 10, the end flaps 18, 20 24 and 26 may be folded inwardly along their respective fold lines 27, to enclose the insert 41 within the envelope for mailing or safekeeping.

On the other hand, when the framed opening 34 is placed on the inside of the envelope 10, it may be conveniently used as an area in which to display a photograph or picture 60, as shown in FIGS. 10 and 11. A photograph 60 can be attached to the surface of the envelope within the framed opening 34 by any suitable means. For example, an adhesive strip (not shown) can be applied to the portions of the envelope visible through the framed opening 34 for application to the back of a photographic print 60 to hold the photograph in place within the framed opening. Once the photograph is in place, the envelope 10 may be closed by folding the end flaps 18, 20, 24 and 26 inwardly over the photograph 60.

Figure 4:
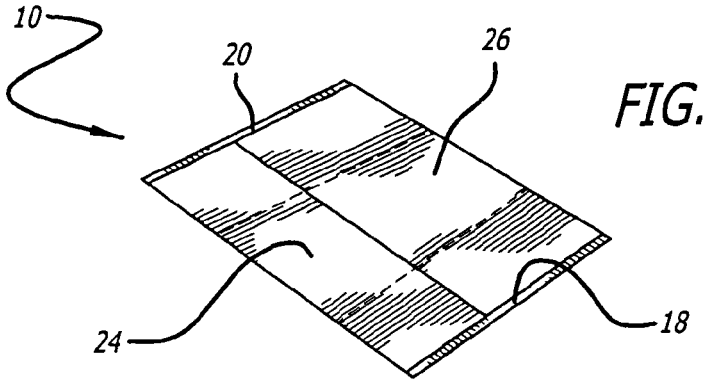
FIG. 4 is a perspective view of the envelope assembly shown in FIG. 1, fully closed, and viewed from the backside of the envelope to show overlapping closure flaps.

In one embodiment, the envelope 10 is closed by first folding the end flaps 18 and 20 at the sides of the envelope 10, as shown in FIG. 3. The next step is to fold the end flap 24 at the bottom of the envelope 10 over the sides flaps 18 and 20, and then fold the end flap 26 at the top of the envelope 10 over the bottom flap 24, resulting in a fully closed envelope as shown in FIG. 4. In order to fully enclose the envelope 10, at least one pair of opposing flaps 26 and 28 can be made long enough to overlap each other when fully folded, as shown in FIG. 4. This will ensure that the entire inner surface of the envelope and any contents within the envelope will be adequately protected when the envelope is closed. On the other hand, the other pair of end flaps 18 and 20 may be made shorter and be disposed so that any material inside the envelope 10, such as an invitation or photograph, is only partially covered by the short flaps when the flaps are folded. Either way, the folded flaps will serve to hold the contents within the envelope on all sides and protect them from damage.

While FIGS. 3 and 4 show the short flaps 18 and 20 at the sides of the envelope 10 and the long flaps 24 and 26 at the top and bottom of the envelope, it will be appreciated that the arrangement could be reversed, if desired, so that the long flaps are at the sides and the short flaps are at the top and bottom. Also, it will be appreciated that the long flaps could be provided on either the first sheet 12 or the second sheet 14, and that the short flaps likewise could be provided on either the first sheet 12 or second sheet 14, as desired.

Once closed, the end flaps can be held securely in place in the folded position by a variety of different means, if desired.

For example, where the flaps 24 and 26 are designed to overlap each other as shown in FIG. 4, an adhesive strip (not shown) may be affixed to the surface of one of the flaps and used to securely seal the flaps together in the overlap region. One such approach would involve the use of a two-sided adhesive strip, with one side being attached to the rear surface of one flap and the exposed side being left covered by a release paper until removed by the user when the envelope is ready to be closed. Of course, other adhesive materials, such as cellophane tape, glue or paste, also may be used. For a more decorative approach, a gummed flap or sticker could be pasted over the exposed free edge of the overlapping flaps as an additional or alternative method of fastening the flaps in the folded position.

Other forms of closure mechanisms also can be used, if desired, to secure the end flaps together and to prevent accidental opening of the envelope. In each of the alternative embodiments to be described below, parts of the envelope that find substantial correspondence in structure and function to those of FIGS. 1-5 are designated with corresponding but primed reference numerals or bear an additional prefix reference numeral.

Figure 6:
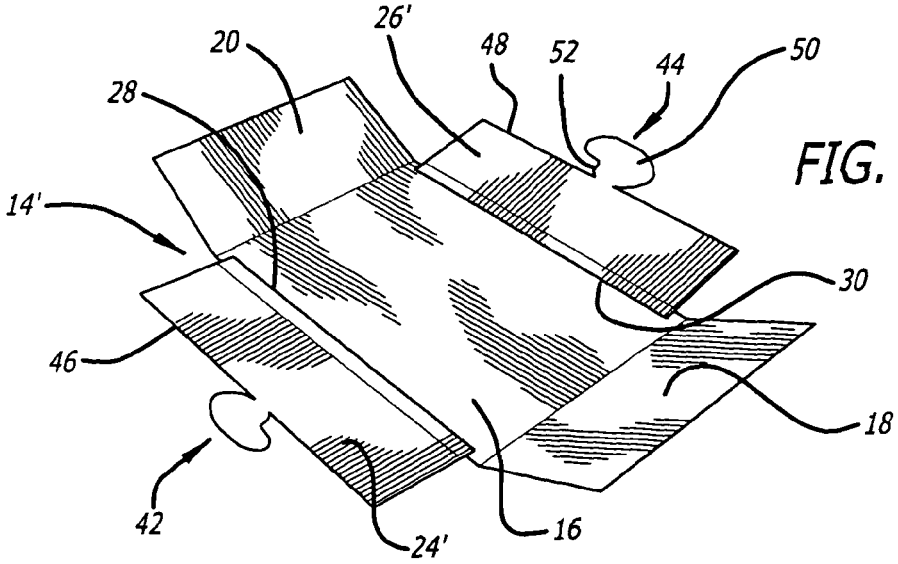
FIG. 6 is a perspective view of an alternative embodiment of the envelope assembly shown in FIG. 1, with locking tabs on two closure flaps.
Figure 7:
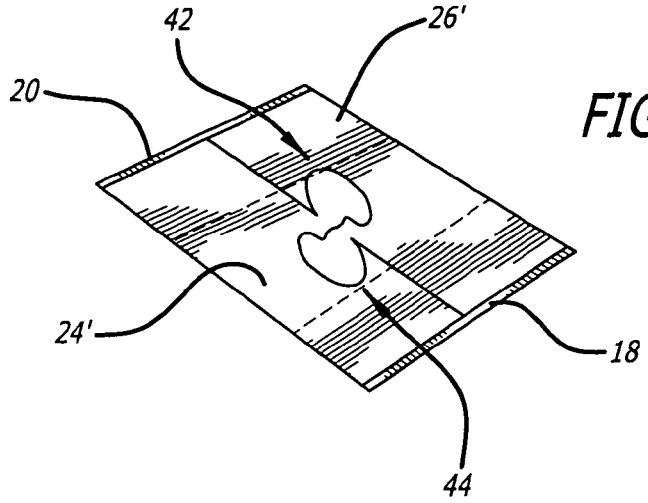
FIG. 7 is a perspective view of the envelope assembly shown in FIG. 6, fully closed, with the locking tabs engaged.

For example, the end flaps on at least one sheet may be provided with complimentary locking tabs adapted to interlock with each other to hold the end flaps in a closed position when the flaps are folded inwardly. One such approach is shown in FIGS. 6 and 7, wherein the end flaps 24' and 26' on the second sheet 14' are provided with locking tabs 42 and 44 formed integral with the free edges 46 and 48 of the flaps and projecting outwardly therefrom in opposite directions. Each locking tab 42 and 44 includes an enlarged lateral head formation 50 with a restricted neck 52 that defines a notch at the base of the neck for receiving the neck portion of the complimentary locking tab in an interlocking relation to fasten the end flaps 24' and 26' together when the flaps are closed, as best shown in FIG. 7. The tabs 42 and 44 are axially offset from each other to enable the neck portions 52 to interlock with each other below the head portions 50. It will be appreciated that the end flaps 24' and 26' used in this embodiment differ from the end flaps 24 and 26 shown in FIGS. 1-5, in that they are sized so that their edges 46 and 48 will meet in abutting fashion when the end flaps are folded, rather than overlap.

Figure 8:
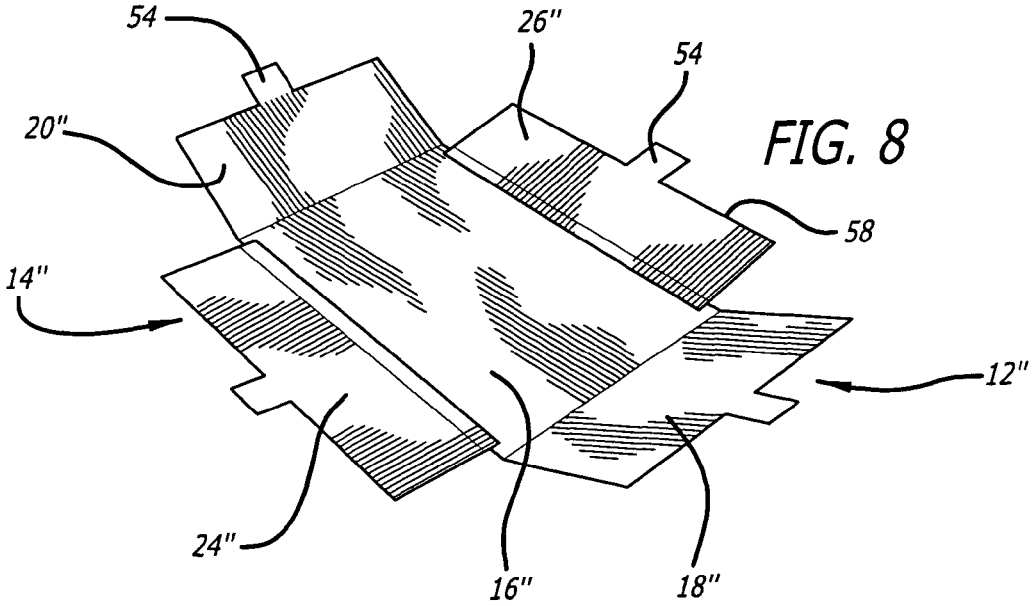
FIG. 8 is a perspective view of another embodiment of the envelope assembly shown in FIG. 1, with locking tabs on all the closure flaps.
Figure 9:
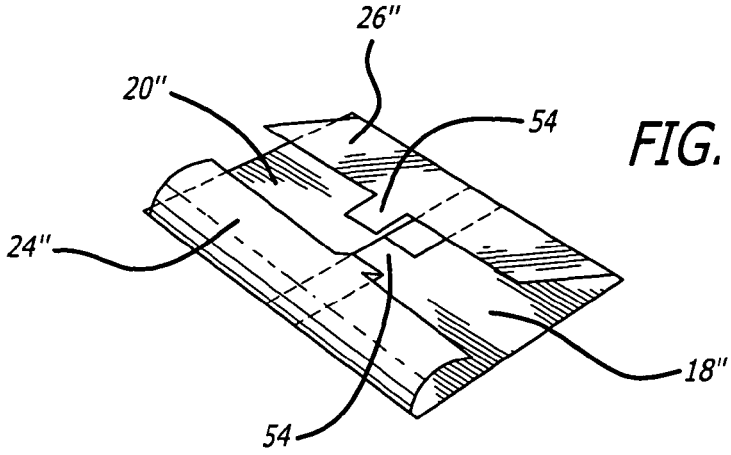
FIG. 9 is a perspective view of the envelope assembly shown in FIG. 8, partially closed, with the locking tabs in the process of being inter-engaged.

In an alternative approach, as shown in FIGS. 8 and 9, the end flaps 18", 20", 24" and 26" of both sheets 12" and 14" are provided with flat projecting locking tabs, or tongues 54 formed integral with the free edges 58 of the flaps, intermediate the sides 60 thereof, and projecting outwardly from the free edges in opposite directions. The tabs 54 on each respective sheet 12" and 14" are in endwise axial alignment with each other. The end flaps 18", 20", 24" and 26" used in this embodiment differ from those used in the last embodiment in that each of the flaps is short and only partially covers the central portion when folded. The distance between the free edges 58 of the folded flaps 18", 20", 24" and 26" is approximately the same as the length of each tab 54. All of the tabs 54 are of approximately the same size in terms of length and width.

To close the envelope, the end flaps 18", 20", 24" and 26" are folded inwardly, one sheet at a time. When the first set of flaps 18" and 20" is folded, the corresponding tabs 54 thereon overlap each other, as shown in FIG. 9. However, as the second set of flaps 24" and 26" is folded, the corresponding locking tabs 54 on those flaps are adapted to be tucked under the first set of locking tabs to interlock the tabs together and hold the flaps in place.

While the end flaps shown in FIGS. 1-9 have a generally rectangular shape, it is contemplated that the end flaps could have different shapes, if desired.

Figure 21:
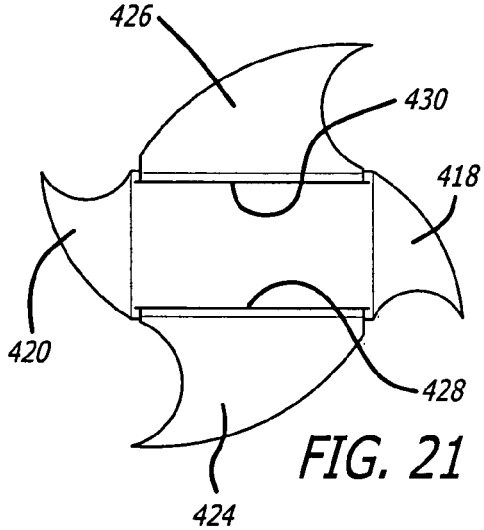
FIG. 21 is a reduced sized plan view of an alternative embodiment of the envelope assembly shown in FIG. 1, showing the end flaps with a fin shape.

A variety of possible end flap shapes is shown in FIGS. 18-21. The end flaps 124 and 126 shown in FIG. 18 have a rounded or dome shape. The end flaps 224 and 226 shown in FIG. 19 have a scalloped edge shape. The end flaps 324 and 326 shown in FIG. 20 have a petal shape resembling the appearance of a flower petal. The end flaps 424 and 426 shown in FIG. 21 are fin-shaped. While the rectangular shape of FIGS. 1-9 may be suitable for more traditional or formal occasions, the stylized shapes of FIGS. 18-21 may be suitable for more festive occasions.

While each of the embodiments shown in FIGS. 1-21, uses the same end flap shape throughout the envelope, it will be appreciated that different flap shapes can be mixed and matched together in a single envelope, if desired. Moreover, the flap sizes could be varied in order to provide the long flap/short flap arrangements described above.

Figure 22:
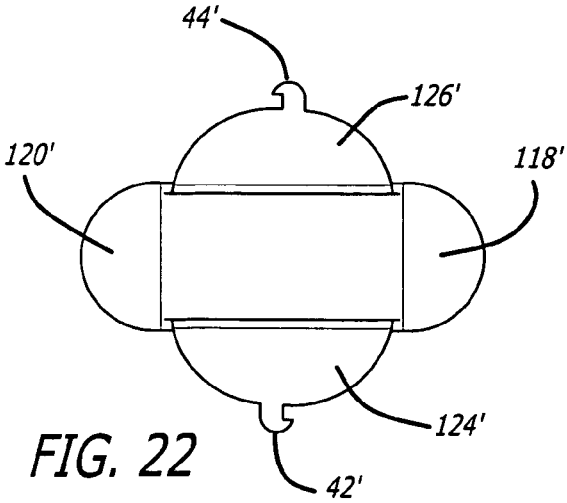
FIG. 22 is a plan view of an alternative embodiment of the envelope assembly shown in FIG. 18, with locking tabs on the two outer closure flaps.
Figure 23:
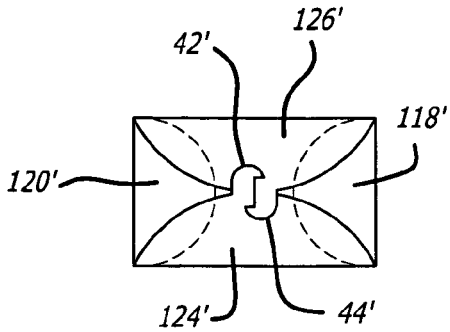
FIG. 23 is a plan view of the envelope assembly shown in FIG. 22, fully closed, and with the locking tabs engaged.

Regardless of the particular shape used, the end flaps can be provided with a locking mechanism of the type described above, if desired. FIGS. 22 and 23 illustrate an example in which complimentary locking tabs 42' and 44', similar to those shown in FIG. 6, are provided on the ends of a pair of rounded flaps 124' and 126'. The locking tabs differ from those in FIG. 6 in that they have a more hook-like or catch-like shape with smaller heads and thicker necks, but they function in a comparable manner.

For ease of manufacture and reduced cost, each sheet utilized in the envelope assembly 10 may be made of a single piece of sheet material, such as paper. A wide variety of different kinds of papers can be used. In one embodiment, the sheets are fashioned from heavy paper or thin cardboard, or other strong and durable paper stock which is flexible enough to be folded back on itself but rigid enough to maintain the envelope's shape. Heavy grade writing paper, drawing paper or stationery paper are suitable, as is relatively stiff or rigid paper of the type used in postcards or greeting cards. The paper can be milled, or if desired, it can be handmade to provide a bulkier or more textured appearance.

In addition to having different colors, the first sheet 12 and the second sheet 14 can be made of papers having different surface textures or different paper types. In one embodiment, especially useful when the framed opening 34 is formed on the inside of the envelope, the second sheet 14, i.e., the one exposed to view through the framed opening 34, can be made of photo paper so that a photograph can be printed directly onto the second sheet for viewing through the framed opening 34 when the envelope is assembled.

In one embodiment, the envelope assembly can be selectively used as a photo mailer then converted into a frame and stand to display a photograph disposed within the framed opening.

Referring once again to FIGS. 10 and 11, in which the framed opening 34 is disposed on the inside of the envelope 10 and a photograph 60 is disposed within the framed opening, it will be appreciated that the envelope may be closed by folding the end flaps 18, 20, 24 and 26 inwardly over the photograph 60, resulting in an envelope suitable for use as a photo mailer or for photo storage. A recipient of the envelope 10 will open the envelope by reversing the closure steps described above to view the photograph 60 inside. Once the envelope 10 has been opened, it then can be transformed by the recipient into a convenient and attractive display stand, whereby the photograph 60 inside can be erected for display within the framed opening 34 by executing a few simple steps, each of which involves opening the flaps 18, 20, 24 and 26, and then folding them backward to form a display stand.

Figure 12:
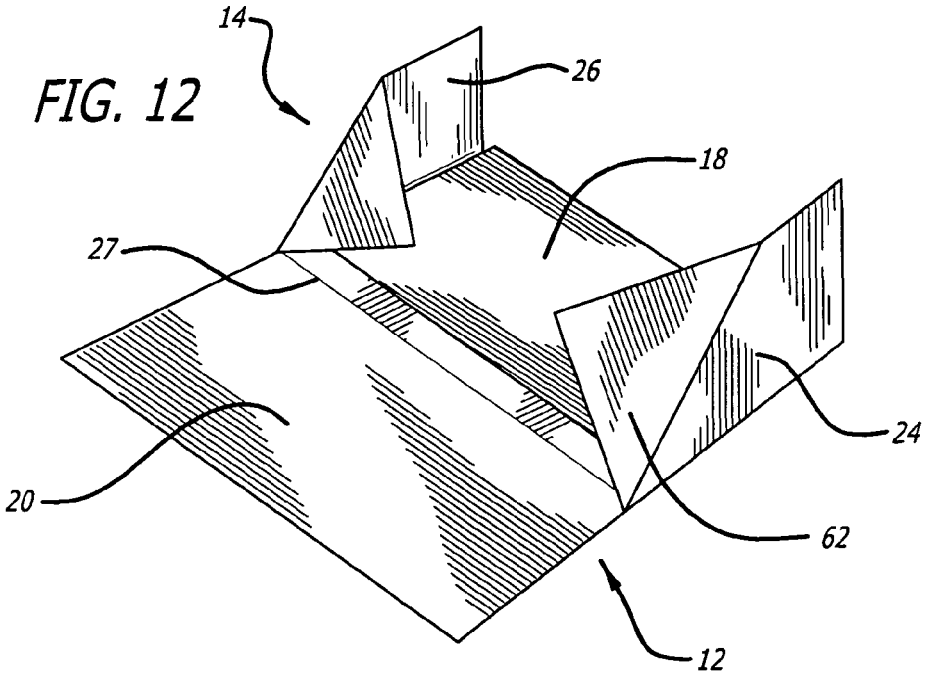
FIG. 12 is a rear perspective view of an alternative embodiment of the envelope assembly shown in FIGS. 10 and 11, with the side flaps folded backwardly and bent at the corners.
Figure 13:
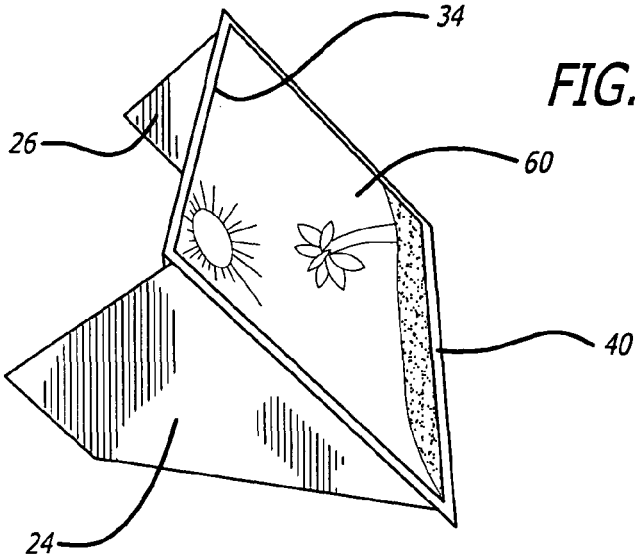
FIG. 13 is a side perspective view of the envelope assembly shown in FIG. 12, erected as a stand for the framed opening.
Figure 14:
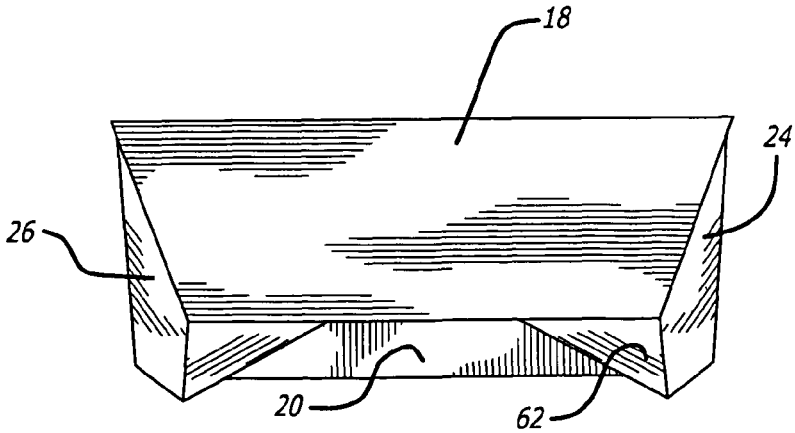
FIG. 14 is a rear perspective view from above of the envelope assembly shown in FIG. 13.

One approach is shown in FIGS. 12-14. With this approach, the first step after opening the envelope is to fold the top flap 18 backward behind the framed opening 34 until it lies flat against the rear surface of the framed opening. Next, the lower portion or corners 62 of the side flaps 24 and 26 are bent backward at generally right angles to the side flaps, and the side flaps are then themselves folded backward behind the framed opening at generally right angles to the rear surface of the framed opening. The resulting configuration is shown in FIG. 12.

Next, the framed portion 34 of the envelope is vertically erected on a table or other support surface (not shown) until the folded lower corners 62 of the side flaps 24 and 26 come to rest on the support surface. With this arrangement, as shown in FIGS. 13 and 14, the side flaps 24 and 26 act as a display stand for the framed opening 34 with the folded corners 62 and the lower flap 20 acting as a base. In this embodiment, the envelope is desirably formed of material with sufficient stiffness so that the flaps will remain folded in proper position and support the weight of the envelope and photograph as shown in the figures.

It should be noted in passing that the embodiment of FIGS. 12-14, has the side flaps 24 and 26 provided by the second sheet 14 and the top and bottom flaps 18 and 20 provided by the first (slitted) sheet 12. In other words, the envelope 10 shown in FIGS. 12-14 has been rotated by 90° from the orientation shown in FIGS. 1-5. It will be appreciated that either orientation can be used, depending on user preference.

Figure 15:
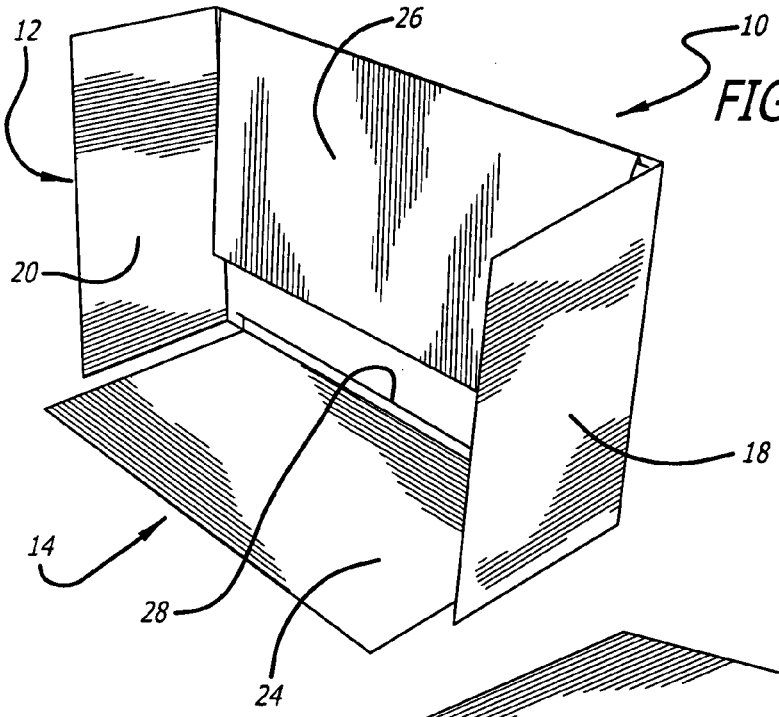
FIG. 15 is a rear perspective view of the envelope assembly shown in FIGS. 10 and 11, with the side flaps folded backwardly for use as a stand.

Turning now to FIG. 15, another approach for transforming the envelope into a display stand is shown. This approach is similar to the one described in relation to FIGS. 12-14, except that the step of bending the corners of the side flaps is omitted. As a consequence, the framed opening 34 is supported in a fully erect, vertical stance, generally perpendicular to the support surface, with no backwards tilting.

Figure 16:
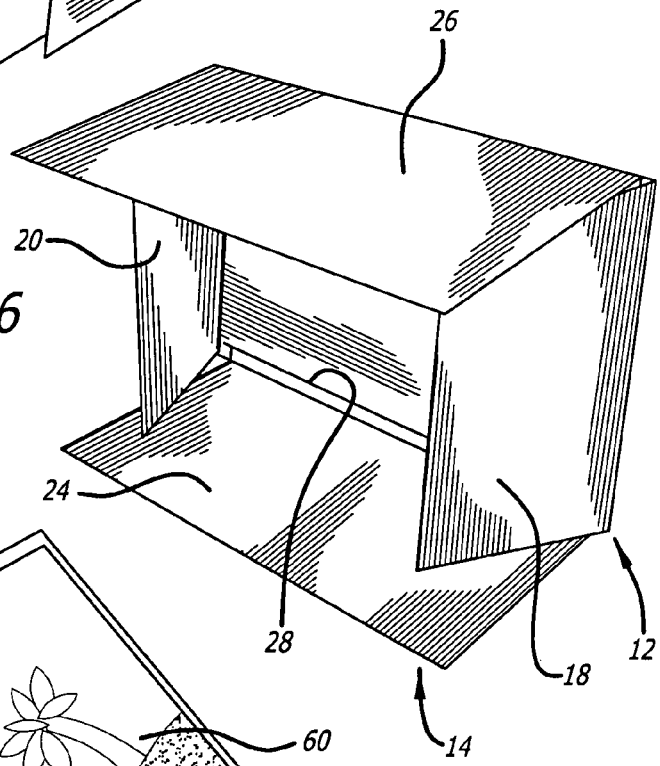
FIG. 16 is a rear perspective view of the envelope assembly shown in FIGS. 10 and 11, and illustrating an alternative arrangement for using the side flaps as a stand.

The approach shown in FIG. 16 is similar to the one described in relation to FIG. 15, with the exception that the side flaps 18 and 20 are folded backwards at an acute angle relative to the rear surface of the framed opening 34, and the top flap 26 is rested on top of the side flaps 18 and 20, instead of laying flat against the rear surface of the framed opening 34. This approach, like the one shown in FIG. 15, erects the framed opening 34 in a vertical, non-tilted stance, but the positioning of the top flap 26 adds stability to the erect structure.

Figure 17:
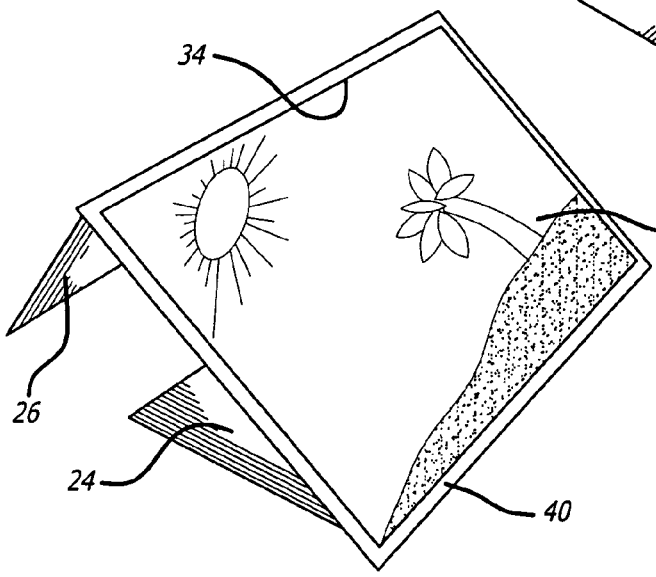
FIG. 17 is a front perspective view of the envelope assembly shown in FIGS. 10 and 11, and showing an arrangement for using the top and bottom flaps as a stand.
Figure 18:
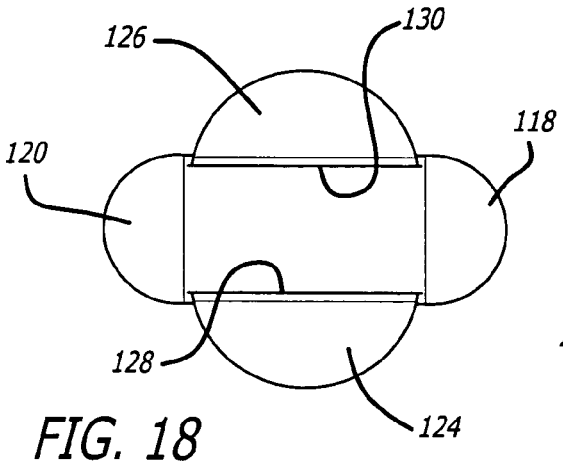
FIG. 18 is a reduced sized plan view of an alternative embodiment of the envelope assembly shown in FIG. 1, showing the end flaps with a rounded shape.
Figure 19:
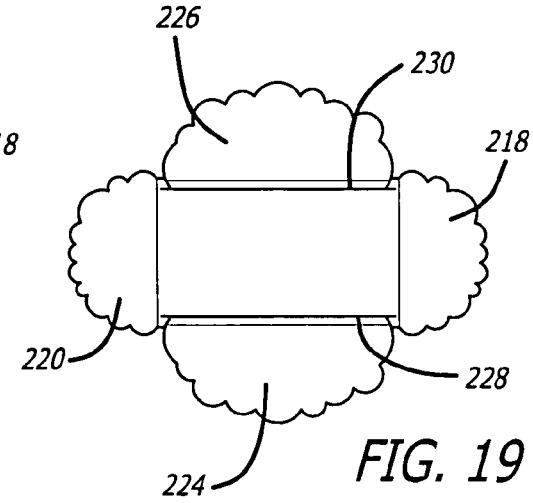
FIG. 19 is a reduced sized plan view of an alternative embodiment of the envelope assembly shown in FIG. 1, showing the end flaps with a scalloped shape.
Figure 20:
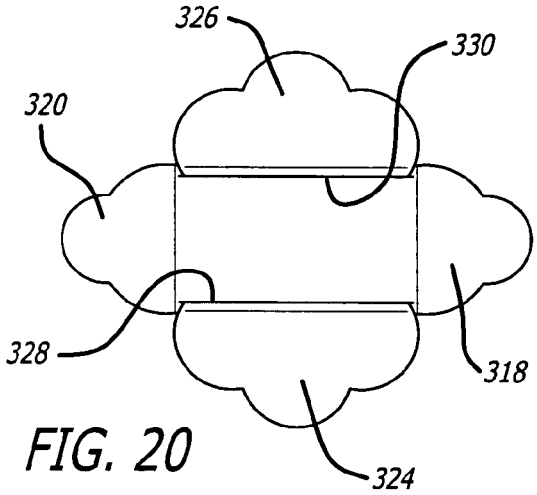
FIG. 20 is a reduced sized plan view of an alternative embodiment of the envelope assembly shown in FIG. 1, showing the end flaps with a petal shape.

The approach shown in FIG. 17 differs from the others in that the side flaps 18 and 20 are folded backward behind the framed opening 34 until they lie flat against the rear surface of the framed opening. The bottom flap 24 is then folded backward and rests on the support surface (not shown), while the top flap 26 is folded backward behind the framed opening 34 at an angle of about 60°-120° with respect to the plane of the framed opening. The envelope is then tilted backward at an angle until the free edge of the top flap 26 comes to rest on the support surface. The result is a framed opening 34 supported at an angle tilted backward, like the framed opening 34 shown in FIGS. 12-14.

The envelopes may be sold to the public in disassembled form as collections or kits of interchangeable loose sheets of different color, texture, flap style or the like, so that the user will have the option of mixing and matching different sheets in different combinations of color, texture or flap style to customize the look of the envelopes he or she wishes to use. Each sheet can be sold pre-creased with fold lines, or, alternatively, left uncreased to allow the user to selectively form his own fold lines. Some sheets in the kit can be pre-slitted for use as the first sheet 12. Alternatively, some or all of the sheets in the kit can be provided with openings in the form of perforations in the area where the slits 28 and 30 would normally be located, allowing the user to selectively use those sheets as either a first sheet (by tearing the sheets along the perforations to open the slits) or as a second sheet (by leaving the perforations intact). In one form, the slitted and un-slitted sheets can be sold separately. For example, a box of slitted sheets of the same color can be sold separately from a box of un-slitted sheets of the same color.

Once assembled, the envelope has a variety of possible uses. For example, it could be used as a formal holder for place cards and the like at a dinner, reception or other affair with assigned seating. It also could be used as an envelope for mailing engraved invitations, letters, postcards, business cards or notes. For those two applications, that the framed opening 34 may be located on the outside of the envelope to provide space for the name and/or name and address of the intended recipient. In the alternative configuration where the framed opening 34 is disposed on the inside of the envelope, the envelope may be used as a photo mailer which can be converted into a display stand for the photograph after the envelope is opened.

From the foregoing, it will be appreciated that the envelope assembly described above allows a user to customize the appearance of the envelope and to vary its intended use in a way which is easy and convenient to apply and inexpensive to produce. The resulting envelope assembly is capable of producing envelopes of unique design with the appearance a framed opening on the outside or on the inside of the envelope, as desired. While suitable for letters, the envelope also is particularly well-suited for use as a photo mailer which can be reconfigured to act as a picture frame and stand to display the photograph once the envelope has been opened.

While several particular forms of the invention have been illustrated and described, it will be appreciated that various modifications can be made without departing from the spirit and scope of the invention.

I claim:

1. An envelope assembly, comprising:

a first sheet;

a second sheet engaged with the first sheet in a crosswise manner;

each sheet having a central portion and two foldable end flaps on opposite sides of the central portion;

the central portion of the first sheet being configured to expose at least a part of the central portion of the second sheet to view through a framed opening defined by a portion of the first sheet, while allowing the end flaps of the second sheet to extend beyond the central portion of the first sheet in a direction traverse to the end flaps of the first sheet when the end flaps are unfolded.

2. Apparatus as set forth in claim 1, wherein a pair of spaced-apart slits are formed in the central portion of the first sheet for receiving and engaging the central portion of the second sheet, the slits being configured to limit displacement of the second sheet toward the end flaps of the first sheet, and the end flaps of the second sheet being joined to the central portion of the second sheet at a distance apart slightly greater than the space between the slits to limit displacement of the second sheet relative to the first sheet when the end flaps of the second sheet are folded inwardly toward the central portion of the first sheet.

3. Apparatus as set forth in claim 2, wherein each of the slits is disposed along an opposite edge of the first sheet at a distance spaced inwardly therefrom and terminates short of connections between the end flaps and the first sheet at each end of the slit, thereby forming a continuous narrow band of material in the central portion of the first sheet that frames said exposed part of the second sheet.

4. Apparatus as set forth in claim 3, wherein each slit terminates short of said end flap connection by a distance substantially equal to the distance between the slits and the adjacent edges of the first sheet, whereby a band of generally uniform width frames said exposed part of the second sheet.

5. Apparatus as set forth in claim 2, wherein the central portion of the second sheet does not protrude outwardly beyond the central portion of the first sheet.

6. Apparatus as set forth in claim 1, wherein the first sheet and the second sheet are formed of different material.

7. Apparatus as set forth in claim 1, wherein the first sheet and the second sheet are different colors.

8. Apparatus as set forth in claim 1, wherein the first sheet and the second sheet have different surface textures.

9. Apparatus as set forth in claim 1, wherein the second sheet is formed of photo paper.

10. Apparatus as set forth in claim 1, wherein the end flaps of at least one sheet are long enough to overlap each other when folded inwardly over the central portion.

11. Apparatus as set forth in claim 10, wherein the end flaps of the other sheet are shorter than the end flaps of the least one sheet and only partially cover the central portion when folded inwardly over the central portion.

12. Apparatus as set forth in claim 1, wherein the end flaps of at least one sheet have edges that meet near the center of the central portion when the flaps are folded inwardly.

13. Apparatus as set forth in claim 1, wherein the end flaps have a shape selected from the group consisting of rectangular, rounded, petal-shaped and fin-shaped.

14. Apparatus as set forth in claim 1, wherein the end flaps have edge shapes selected from the group consisting of straight, curved and scalloped.

15. Apparatus as set forth in claim 1, wherein the end flaps on at least one sheet are provided with complimentary locking tabs adapted to interlock with each other to hold the end flaps in a closed position when the end flaps are folded inwardly.

16. Apparatus as set forth in claim 15, wherein each of the locking tabs has a lateral formation with a restricted neck that defines a notch adapted to receive the neck of the corresponding locking tab in an interlocking relation to fasten the end flaps together.

17. Apparatus as set forth in claim 1, wherein the end flaps on both sheets are provided with locking tabs projecting outwardly from free edges of each end flap, the locking tabs on one sheet being axially aligned and providing a first set of locking tabs adapted to overlap each other when the corresponding end flaps are folded inwardly, the locking tabs on the other sheet being axially aligned with each other and providing a second set of locking tabs adapted to be tucked under the first set of locking tabs when the corresponding end flaps are folded inwardly to fasten the ends flaps together in an interlocking relation.

18. Apparatus as set forth in claim 1, wherein the exposed part of the second sheet is selectively provided on the inside or the outside of the envelope.

19. Apparatus as set forth in claim 18, wherein the exposed part of the second sheet is provided on the inside of the envelope and is adapted for displaying a photograph in the framed opening, the end flaps being foldable over the photograph to cover and protect the photograph when the envelope is closed.

20. Apparatus as set forth in claim 1, wherein upon backward folding of the end flaps behind the framed opening, said framed opening will be supported and erected by at least one of said end flaps.

21. Apparatus as set forth in claim 20, wherein the end flaps at the sides of the framed opening are folded backwardly behind the framed opening, each of said backwardly folded end flaps having a lower portion bent inwardly at a generally right angle to the end flap to form a base for supporting the end flaps and for erecting said framed opening tilted backward at an angle.

22. A kit of interchangeable parts for forming an envelope assembly, comprising:

a plurality of sheets, each sheet having a central portion and two foldable end flaps on opposite sides of the central portion, at least some of the sheets having openings formed therein configured to provide a pair of spaced-apart slits in the central portion thereof adapted to receive and engage the central portion of other sheets in the kit for holding the sheets together in an inter-engaged manner to form an envelope assembly, said other sheets being free of said openings and including sheets of different color than the sheets having said openings formed therein.

* * * * *